US010946650B2

(12) United States Patent
Kato

(10) Patent No.: US 10,946,650 B2
(45) Date of Patent: Mar. 16, 2021

(54) LIQUID EJECTION HEAD

(71) Applicant: CANON KABUSHIKI KAISHA, Tokyo (JP)

(72) Inventor: Masataka Kato, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/725,425

(22) Filed: Dec. 23, 2019

(65) Prior Publication Data

US 2020/0198350 A1 Jun. 25, 2020

(30) Foreign Application Priority Data

Dec. 25, 2018 (JP) ..... JP2018-240865

(51) Int. Cl.
*B41J 2/14* (2006.01)

(52) U.S. Cl.
CPC .. *B41J 2/14145* (2013.01); *B41J 2002/14419* (2013.01)

(58) Field of Classification Search
CPC B41J 2/14145; B41J 2202/12; B41J 2202/18; B41J 2/1628; B41J 2/1631; B41J 2/14129; B41J 2/1603
See application file for complete search history.

(56) References Cited

U.S. PATENT DOCUMENTS 7,523,553 B2 * 4/2009 Ohsumi ..... B41J 2/1603 216/27
7,802,878 B2 9/2010 Kyoso
8,518,725 B2 8/2013 Terasaki et al.
2016/0271949 A1 * 9/2016 Yamamuro ..... B41J 2/1639
2018/0361742 A1 * 12/2018 Higuchi ..... B41J 2/14064
2019/0001675 A1 * 1/2019 Kato ..... B41J 2/1433
2020/0101478 A1 * 4/2020 Hayashi ..... B05B 11/043
2020/0101730 A1 * 4/2020 Mizuno ..... B41J 29/377
2020/0101746 A1 * 4/2020 Mukoyama ..... B41J 2/17509
2020/0122465 A1 * 4/2020 Hiramoto ..... B41J 2/1642

FOREIGN PATENT DOCUMENTS

JP 10-34928 A 2/1998
JP 10-95119 A 4/1998
JP 2008-142910 A 6/2008
JP 2011-161915 A 8/2011

* cited by examiner

*Primary Examiner* — Huan H Tran
(74) *Attorney, Agent, or Firm* — Venable LLP

(57) ABSTRACT

A liquid ejection head has on one surface of a substrate a liquid flow path having an ejection orifice and a liquid generating energy generating element while the element is protected against liquid by an insulating layer formed on the surface. The liquid ejection head further has a liquid inflow path and a liquid outflow path each running through the substrate and the insulating layer to circulate liquid. The liquid inflow path and the liquid outflow path each have a first opening on the surface of the substrate and a second opening on the surface of the insulating layer and for each of the liquid inflow and outflow paths, the end on the ejection orifice side of the second opening is located closer to the ejection orifice than the end on the ejection orifice side of the first opening.

12 Claims, 10 Drawing Sheets

LIQUID EJECTION HEAD

BACKGROUND OF THE INVENTION

Field of the Invention

The present invention relates to a liquid ejection head.

Description of the Related Art

Known liquid ejection heads to be used for recording apparatus such as inkjet printers include those that have a flow path formed on a substrate, which in turn have supply paths formed therein, and are so designed that energy is applied from energy generating elements to the liquid flowing through the flow path to cause the liquid to be ejected from ejection orifices. Japanese Patent Application Laid-Open No. 2011-161915 describes a liquid ejection head having a substrate in which through holes of two different types are formed as supply paths. The two types of through holes include individual supply paths that are independent from each other and common supply paths that are commonly shared by the independent supply paths. This arrangement of supplying liquid from the independent supply paths to the flow path on the substrate improves the liquid supply ability of the liquid ejection head and stabilizes the operation of the liquid ejection head in terms of the direction of liquid ejection. Then, as a result, the liquid ejection head can eject liquid highly accurately at high speed for recording operations.

When the energy generating elements of a liquid ejection head are left undriven for a long period of time, the liquid contained in the pressure chambers where the energy generating elements are arranged is exposed to external air at and near the ejection orifices for a long time to consequently sometimes allow the volatile components in the liquid to evaporate to a certain extent. As the volatile components in the liquid evaporate to a certain extent, the concentration of the coloring material and those of some of the other ingredients in the liquid change to give rise to color unevenness in the recorded image and shifts of ink landing positions due to a rise in the viscosity of the liquid to make it difficult to accurately form an intended image. As a measure to cope with the above-identified problem, circulation type liquid ejection devices designed to circulate the liquid supplied to the pressure chambers of the liquid ejection head thereof by way of a circulation circuit have been devised and are known.

Japanese Patent Application Laid-Open No. 2008-142910 discloses a liquid ejection device comprising a circulation circuit starting from a liquid tank and coming back to the liquid tank by way of a common inflow path, individual inflow paths, pressure chambers, individual outflow paths and a common outflow path and designed to minimize the rise in the viscosity of the liquid located at and near the ejection orifices that are not being employed to eject liquid.

On the other hand, liquid ejection heads are required to quickly refill the flow path on the energy generating elements after ejecting liquid therefrom in order to realize faster recording operations. An effective measure to meet this requirement is to curtail the length of the flow path from the supply paths to the energy generating elements and thereby reduce the flow resistance of the supply path. Each of Japanese Patent Application Laid-Open No. H10-095119 and Japanese Patent Application Laid-Open No. H10-034928 discloses a non-circulation type liquid ejection head in which the flow path is elevated relative to the supply paths at and near the supply paths by scraping off the substrate there. Such a liquid ejection head can reduce the flow resistance from the supply paths to the energy generating elements and improve the refilling efficiency.

SUMMARY OF THE INVENTION

A liquid ejection head according to the present invention comprises:

a liquid flow path having an ejection orifice; and an energy generating element for generating energy for ejecting liquid from the flow path through the ejection orifice, the liquid flow path and the energy generating element being formed on a first surface of a substrate having the first surface and a second surface disposed oppositely relative to each other, the energy generating element being protected against liquid by an insulating layer formed on the first surface of the substrate, the liquid ejection head further comprising:

a liquid inflow path running through the substrate and the insulating layer so as to allow liquid to flow into the flow path from the second surface side of the substrate; and a liquid outflow path running through the substrate and the insulating layer so as to allow liquid to flow out from the flow path to the second surface side of the substrate, the liquid inflow path and the liquid outflow path respectively having first openings formed on the first surface of the substrate after running through the substrate and second openings formed on the insulating layer after running through the insulating layer, the ejection orifice being arranged between the liquid inflow path and the liquid outflow path, the ejection orifice side end of the second opening being located closer to the ejection orifice than the ejection orifice side end of the first opening for each of the liquid inflow path and the liquid outflow path, the relationships of $L1 \geq L2$ and $L3 \geq L4$ holding true, with the proviso that $L3 \geq L4$ when $L1 = L2$ and $L1 > L2$ when $L3 = L4$, where L1 is the distance from the center position of the ejection orifice to the ejection orifice side end of the first opening of the liquid inflow path;

L2 is the distance from the center position of the ejection orifice to the ejection orifice side end of the first opening of the liquid outflow path;

L3 is the distance from the center position of the ejection orifice to the ejection orifice side end of the second opening of the liquid inflow path; and L4 is the distance from the center position of the ejection orifice to the ejection orifice side end of the second opening of the liquid outflow path.

Further features of the present invention will become apparent from the following description of exemplary embodiments with reference to the attached drawings.

DESCRIPTION OF THE EMBODIMENTS

Figure 1A:
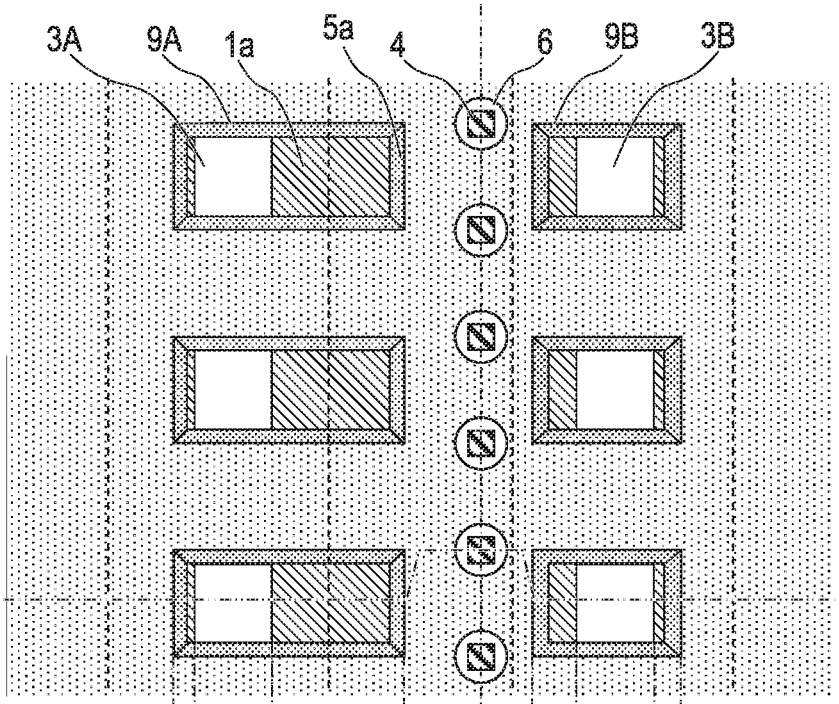
FIGS. 1A and 1B are respectively a schematic top view and a schematic cross-sectional view of the first embodiment of liquid ejection head according to the present invention.

A liquid ejection device having a circulation circuit as disclosed in Japanese Patent Application Laid-Open No. 2008-142910 can be employed in a variety of instances such as an instance where a special liquid is to be used, an instance where it is to be operated in very high temperature environments, an instance where liquid is to be circulated at a low flow rate and an instance where the height of the flow paths of the pressure chambers is small and the ejection orifices have a large area. In any of such instances, liquid can easily be evaporated from the ejection orifices and consequently highly dense portions of the liquid in the liquid ejection device can linger at and near the ejection orifices. Then, if liquid is made to circulate in the liquid ejection device, the highly dense portions of the liquid lingering at and near the ejection orifices may not satisfactorily be replaced. As a result, there arise instances where the recorded image shows a poor image quality.

Therefore, the object of the present invention is to provide a liquid ejection head having a liquid circulation circuit that can structurally reduce the density of the highly dense portions of the liquid lingering at and near the ejection orifices under any conditions.

Now, embodiments of liquid ejection head according to the present invention will be described by referring to the accompanying drawings. Note that, while detailed specific descriptions may be given to the embodiments in order to make them fully understandable, they are only currently technically preferable embodiments and the scope of the present invention is not limited by those descriptions in any means.

A liquid ejection head is a member that belongs to a recording apparatus such as an inkjet printer. Other members of a recording apparatus normally include a liquid container for containing liquid to be supplied to the liquid ejection head and a conveyance mechanism for conveying a recording medium to be used for image recording. A liquid ejection head according to the present invention is applicable to a recording apparatus having a circulation mechanism for circulating the liquid located at and near the ejection orifices and comprises a circulation circuit for circulating the liquid. With this arrangement, the liquid in the flow paths of the liquid ejection head can be circulated between the inside and the outside of the liquid ejection head.

Meanwhile, in a known liquid ejection head having such a circulation circuit, the density of the portions of the liquid in the liquid ejection head located at and near the ejection orifices is apt to be raised but can be reduced by such circulation of liquid. However, under certain conditions, there can arise instances where the density of the highly dense portions of the liquid (even if it is circulating) in the liquid ejection head located at and near the ejection orifices is not satisfactorily reduced to consequently make the recorded image show a poor image quality. Such conditions include those under which a special liquid is employed, those under which the liquid ejection head is operated in a high temperature environment and those under which liquid is circulated at a low flow rate. Such conditions further include those under which liquid can easily evaporate from the ejection orifices particularly when the height of the flow paths located at and near the energy generating elements (which are also referred to as pressure chambers) is small and the ejection orifices have a large area. On the other hand, the present invention provides a liquid ejection head having a structure that can satisfactorily reduce the density of the highly dense portions of the liquid in the liquid ejection head by circulation under any conditions.

Now, the present invention will be described further by way of embodiments.

First Embodiment

Figure 1B:
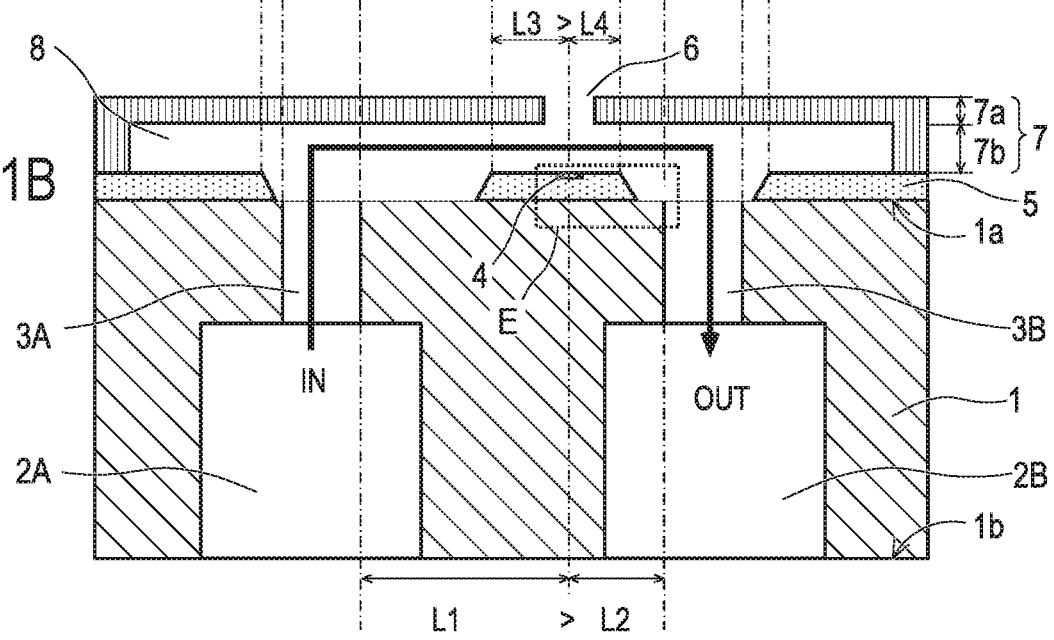

FIGS. 1A and 1B respectively show a schematic plan view of this embodiment of liquid ejection head (FIG. 1A) and a schematic cross-sectional view of the embodiment taken along line 1B-1B in FIG. 1A (FIG. 1B). The liquid ejection head comprises a substrate 1. The substrate 1 is typically made of silicon. Supply paths that run through the substrate from the first surface 1*a* of the substrate 1 (to be simply referred to as "front surface" hereinafter) to the second surface 1*b* of the substrate 1 (to be simply referred to as "rear surface" hereinafter) are formed in the substrate 1. In the embodiment of FIGS. 1A and 1B, the supply paths include the first supply paths 2 and the second supply paths 3. The supply paths run through the substrate 1 from the rear surface side to the front surface side of the substrate 1 and liquid is supplied from the rear surface side to the front surface side. Energy generating elements 4 for generating energy to be used to eject liquid, an electric wiring layer (not shown) that is electrically connected to the energy generating elements 4 and an insulating layer 5 for protecting the energy generating elements 4 and the electric wiring layer against liquid are arranged on the front surface of the substrate 1. The energy generating elements 4 may typically be resistance heating elements (heater elements) that are made of, for instance, TaSiN. The electric wiring layer may typically be an Al-made wiring layer. The insulating layer may typically be an inorganic insulating layer that is made of, for instance, silicon nitride (SiN), silicon carbide (SiC) or silicon oxide (SiO, $SiO_2$). The insulating layer 5 has opening regions 9 and the supply paths (second supply paths 3) have openings respectively arranged within the opening regions 9 on the front surface of the substrate. In the following description, the openings in the respective opening regions 9 on the front surface of the insulating layer will be referred to as the second openings, while the openings of the (second) supply paths on the front surface of the substrate will be referred to as the first openings. An ejection orifice member 7 for forming ejection orifices 6 for ejecting liquid is arranged on the front surface of the substrate 1. In FIGS. 1A and 1B, it will be seen that the ejection orifice member 7 is formed by two layers of an ejection orifice forming part 7*a* and a flow path forming part 7*b*. The ejection orifice member 7 is made of a material typically selected from resin materials (such as epoxy resin), silicon and metals. The region surrounded by the ejection orifice member 7 and the front surface of the substrate 1 operates as liquid flow path 8. Parts of the flow path 8 that respectively include the energy generating elements 4 are referred to as pressure chambers. The liquid in the pressure chambers to which energy is applied from the energy generating elements 4 is ejected from the ejection orifices 6. The plurality of ejection orifices 6 and the plurality of energy generating elements 4 are arranged in row in the direction shown in FIG. 1A (in the direction running from top to bottom in FIG. 1A) and the first supply paths 2 are formed so as to extend in the direction in which the energy generating elements 4 (ejection orifices) are arranged in row (in the direction running from top to bottom in FIG. 1A) (in the area defined by broken lines in FIG. 1A). While a pair of second supply paths 3 is provided for every two energy generating elements 4 (ejection orifices) in this embodiment, the present invention is not limited to such an arrangement and a pair of second supply paths 3 may alternatively be provided for every energy generating element 4 or for every three or more energy generating elements 4.

As described above, the supply paths include the first supply paths 2 and the second supply paths 3. A plurality of second supply paths 3 that are independent from each other are provided to each of the first supply paths 2. For this reason, the first supply paths 2 may be referred to as common supply paths and the second supply paths 3 may be referred to as individual supply paths. While the supply paths have two types of supply paths including the first supply paths 2 and the second supply paths 3 in this embodiment, alternatively a single type of supply paths may be provided. In other words, supply paths of a single type may be made to run through the substrate 1.

In the instance of a liquid ejection head that is designed to circulate liquid, supply paths are arranged at the opposite sides of the row of energy generating elements 4 so as to sandwich the row of energy generating elements 4 between the two rows of supply paths. The second supply paths (individual supply paths) 3 include individual inflow paths 3A for flowing liquid into the flow path 9 (pressure chambers) and individual outflow paths 3B for flowing liquid out from the flow path 8 (pressure chambers). Additionally, the first supply paths (common supply paths) 2 include a common inflow path 2A that is held in communication with the plurality of individual inflow paths 3A and a common outflow path 2B that is held in communication with the plurality of individual outflow paths 3B. The individual inflow paths 3A and the common inflow path 2A may also collectively be referred to simply as liquid inflow paths, while the individual outflow paths 3B and the common outflow path 2B may also collectively be referred to as liquid outflow paths.

In the instance of this embodiment, as shown in FIG. 1B, the ejection orifices 6 are arranged between the liquid inflow paths (individual inflow paths 3A) and the liquid outflow paths (individual outflow paths 3B) and the ends of the second openings on the side of the ejection orifices are arranged closer to the ejection orifices than the corresponding ends of the first openings on the side of the ejection orifices. L1 through L4 indicate the distances respectively from the straight center line connecting the center positions of the ejection orifices 6 to the ends of the first and second openings on the side of the ejection orifices. More specifically, L1 indicates the distance from the center line of the ejection orifices to the end of the first opening of each of the liquid inflow paths on the side of the ejection orifices and L2 indicates the distance from the center line of the ejection orifices to the end of the first opening of each of the liquid outflow paths on the side of the ejection orifices. Similarly, L3 indicates the distance from the center line of the ejection orifices to the end of the second opening of each of the liquid inflow paths on the side of the ejection orifices and L4 indicates the distance from the center line of the ejection orifices to the end of the second opening of each of the liquid outflow paths on the side of the ejection orifices. According to the present invention, the relationships of L≥L2 and L3≥L4 hold true. More particularly, L3>L4 when L1=L2, whereas L1>L2 when L3=L4. The above distances refer to the shortest distances when viewed from a position facing the front surface of the substrate. The center position of an ejection orifice is the position of the center of gravity of the ejection orifice 6. Note that, in FIGS. 1A and 1B, the ejection orifices 6 and the energy generating elements 4 that respectively correspond to the ejection orifices 6 are positionally so arranged as to make the relationship of L1>L2 and L3>L4 hold true. Additionally, the relationship of L2+L4<L1+L2 holds true because the ends of the second openings on the side of the ejection orifices are formed at positions located closer to the ejection orifices than the ends of the first openings on the side of the ejection orifices.

Figure 7A:
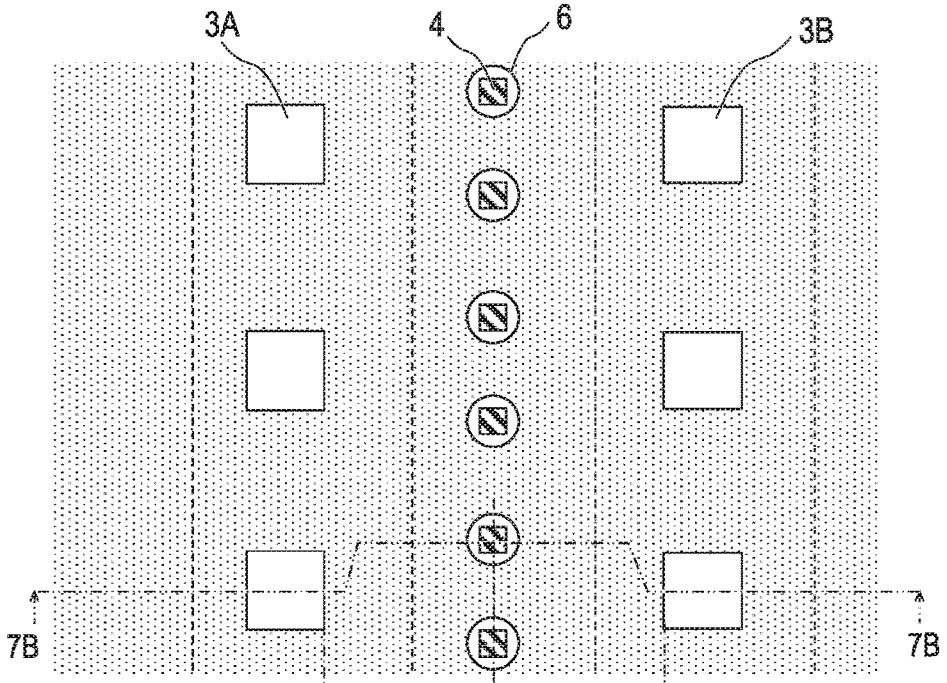
FIGS. 7A and 7B are respectively a schematic top view and a schematic cross-sectional view of a known liquid ejection head.
Figure 7B:
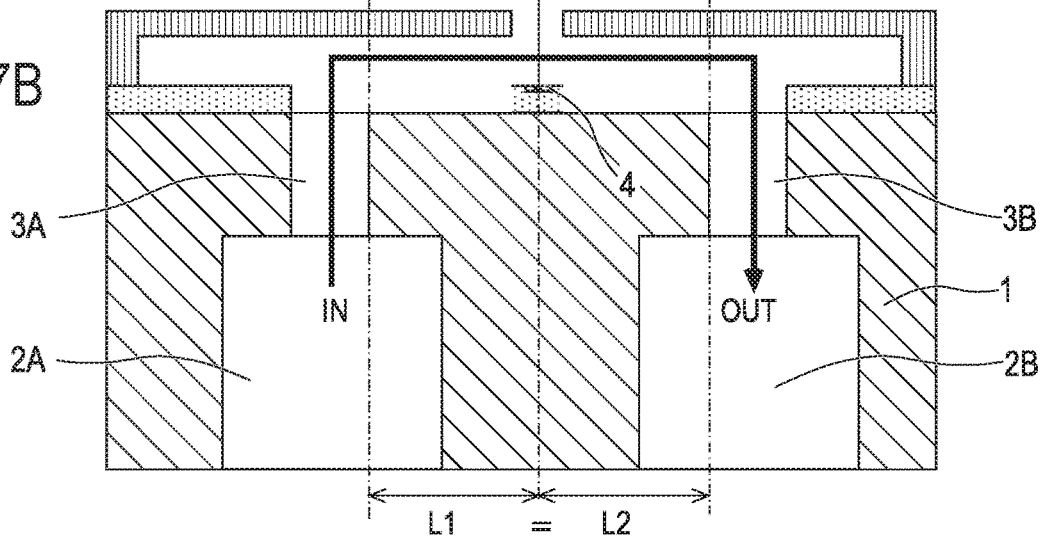

In the instance of known liquid ejection heads, on the other hand, L1=L2 and L3=L4, as shown in FIGS. 7A and 7B, because the insulating layer is not scraped off (in horizontal directions) and the first openings positionally agree respectively with the second openings when viewed from above. Thus, all the flow paths arranged on the opposite sides of the ejection orifices, which are arranged symmetrically relative to the center line of the ejection orifices, substantially show the same flow resistance.

Figure 3:
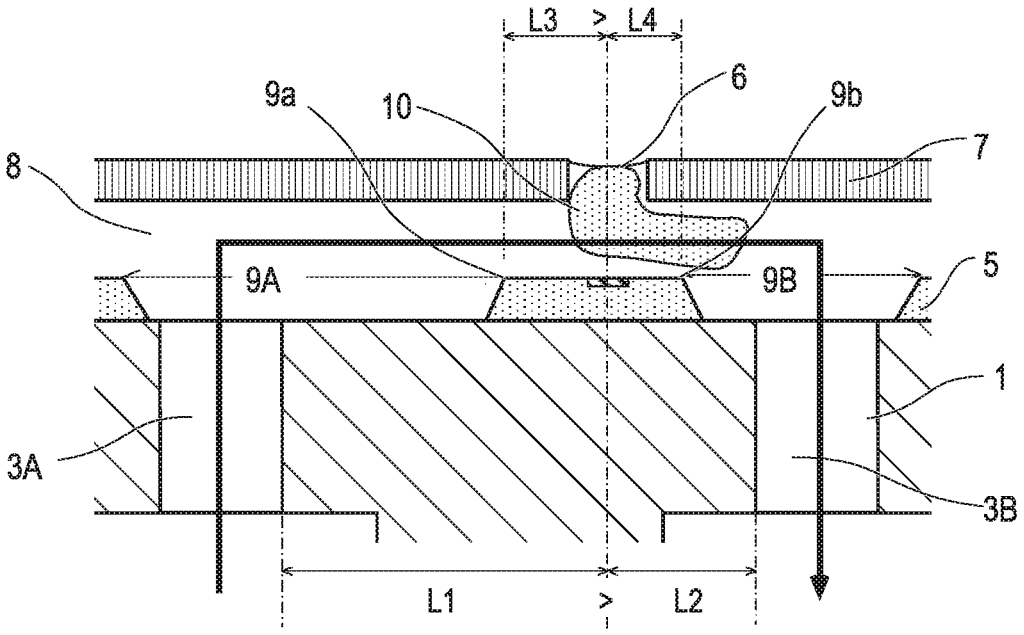
FIG. 3 is a schematic illustration of the flow of liquid in the first embodiment of liquid ejection head according to the present invention.

FIG. 3 is an enlarged schematic view of a part of the liquid ejection head of the first embodiment that surrounds one of the ejection orifices illustrated in FIG. 1B. When L1>L2 and at the same time L3>L4 as shown in FIG. 3, portion 10 of the liquid in the liquid ejection head that shows a high density is located close to the corresponding one of the individual outflow paths 3B and liquid is circulated by a large amount there to consequently reduce the density of the highly dense portion 10.

As pointed out above, techniques of reducing the flow resistance from the supply paths to the respective energy generating elements, which supply paths are to be employed for liquid refilling, are known for non-circulation type liquid ejection heads. Thus, it is conceivable to reduce the flow resistance by arranging both the individual inflow paths and the individual outflow paths at positions located close to the energy generating elements (ejection orifices). However, the partition wall separating the common inflow path and the common outflow path is required to have a thickness that is not smaller than a predetermined value in order to provide it with satisfactory mechanical strength. Therefore, if the gap separating each of the individual outflow paths and the corresponding one of the individual inflow paths is reduced, the individual outflow paths and the individual inflow paths can ride on the partition wall to produce right-angled bends there to partly move away from the common supply paths. Such bends can be formed only by etching the substrate from the opposite surface sides (the front surface side and the rear surface side) of the substrate. Then, burrs can easily appear at and near the bends to make it difficult to produce accurate connections there.

In this embodiment of a circulation type liquid ejection head, the length of the flow path to each of the energy generating elements is reduced only on the side of the liquid outflow paths to give rise to an effect of reducing the flow resistance against the circulating liquid there. Due to this effect of reducing the flow resistance, the highly dense portions 10 of the liquid in the liquid ejection head that appear at and near the ejection orifices can quickly be pushed out to flow into the respective corresponding individual outflow paths. Therefore, the flow resistance can further be reduced even by making the gap separating each of the individual outflow paths and the corresponding one of the individual inflow paths large enough so as to avoid a situation where the individual outflow paths and the individual inflow paths ride on the partition wall between the common inflow path and the common outflow path and by reducing the gap between the ends of any two adjacently located openings that are formed on the insulating layer.

Figure 2:
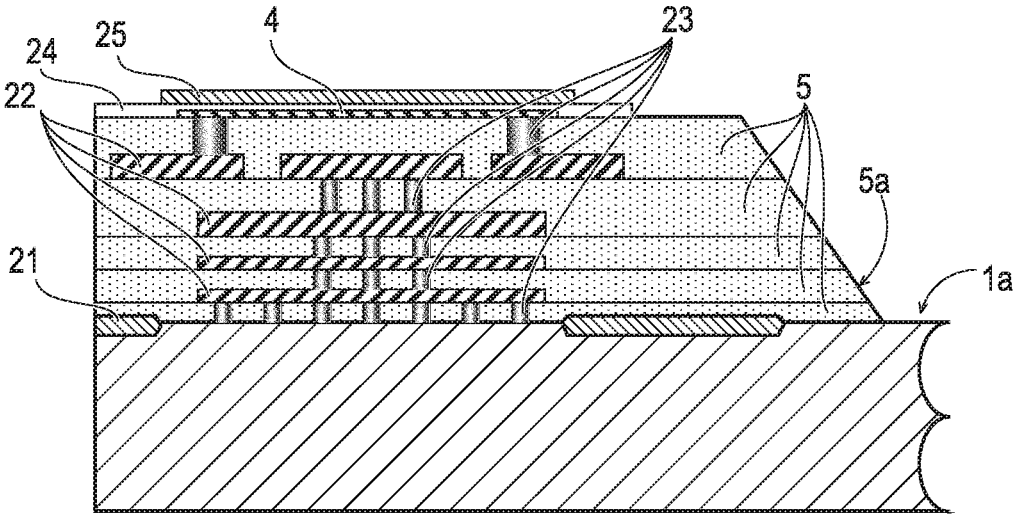
FIG. 2 is an enlarged schematic cross-sectional view of the first embodiment of liquid ejection head according to the present invention.

In a liquid ejection head, semiconductor elements such as switching elements can be formed on the silicon substrate, which is a semiconductor substrate, of the liquid ejection head and the energy generating elements can be driven by way of multilayer wiring. FIG. 2 is an enlarged schematic cross-sectional view of portion E surrounded by a dotted line in FIG. 1B that is located near one of the openings on the front surface side of the substrate 1. In FIG. 2, the lateral wall of the second supply path 3 shown there has a rippled profile, which can often be produced when the second supply paths 3 are formed by way of a Bosh process. Oxide film 21 is formed on the front surface side of the substrate 1 and the insulating layer 5 is arranged on the oxide film 21. The insulating layer 5 has a multilayer structure formed by laying a plurality of component insulating layers and such a multilayer structure can typically be formed by means of plasma CVD. Electric wiring layers 22 are arranged among the plurality of component insulating layers 5. More specifically, a plurality of electric wiring layers 22 are formed and connected to each other by way of plugs 23. The plugs 23 may typically be tungsten plugs. The plugs are surrounded by the insulating layer 5. Thus, each of the electric wiring layers 22 is electrically insulated at parts thereof where no plug 23 is found. The electric wiring layers 22 are electrically connected to the energy generating elements 4 to supply the energy generating elements 4 with electricity. Additionally, the energy generating elements 4 are prevented from contacting the liquid to be ejected from the liquid ejection head by a passivation layer 24 and an anti-cavitation layer 25 is arranged on the passivation layer 24.

The electric wiring layers are preferably produced by laying a plurality of electric wirings one above the other. With such an arrangement, the insulating layers are made to have a large height, which in turn can raise the refilling efficiency when the ends of the openings of the insulating layer are retracted from the respective corresponding openings of the liquid supply paths. More specifically, the insulating layer 5 preferably has a thickness of not less than 4 μm, more preferably not less than 6 μm. When the insulating layer 5 is formed by a plurality of component insulating layers, the thickness of the insulating layer 5 is equal to the sum of the thicknesses of the component insulating layers. Furthermore, when electric wiring layers are arranged among the component insulating layers, the thickness of the insulating layer 5 includes the thicknesses of the electric wiring layers. By making the insulating layer have such a thickness, the opening regions 9 of the insulating layer 5 can be made to show a large height to in turn reduce the flow resistance of the liquid circulating in the liquid ejection head. While there is no upper limit to the thickness of the insulating layer, it is preferably not greater than 20 μm when the overall design of the liquid ejection head is taken into consideration. Note that it is not necessary to scrape off the insulating layer by all the height thereof to produce the opening regions 9 of the insulating layer. In other words, the opening regions 9 of the insulating layer can be produced by scraping off the insulating layer only by part of its height. In the instance of FIGS. 1A and 1B, a flat area is produced by scraping off the insulating layer from the bottom of the wall surface of each of the opening regions of the insulating layer 5 (to be referred to as "opening wall surface" or simply as "wall surface" hereinafter) on the side of the liquid inflow paths to the end (on the side of the ejection orifices in particular) of the corresponding first opening (the opening of the corresponding individual inflow path 3A on the front surface side of the substrate) on the side of the liquid inflow paths. Similarly, a flat area is produced by scraping off the insulating layer 5 from the bottom of the opening wall surface of the insulating layer 5 to the end (on the side of the ejection orifices in particular) of the corresponding first opening (the opening of the corresponding individual outflow path 3B on the front surface side of the substrate) on the side of the liquid outflow paths.

When L1>L2 as shown in FIGS. 1A and 1B, L1/L2 is preferably made to be not smaller than 1.1. When L1/L2 is made to be not smaller than 1.1, the density of the highly dense portions of the liquid in the liquid ejection head can efficiently be reduced. Additionally, when L3>L4, L3/L4 is also preferably made to be not smaller 1.1.

Now, the method of manufacturing the liquid ejection head of this embodiment of the present invention will be described below by referring to FIGS. 8A through 8F.

Figure 8A:
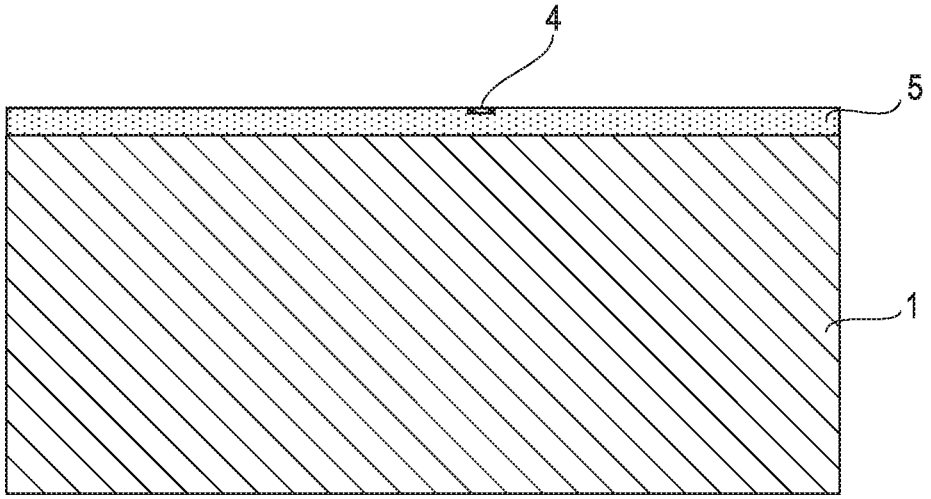
FIGS. 8A, 8B, 8C, 8D, 8E and 8F are schematic cross-sectional views showing the different manufacturing steps of the method of Example 1.

First, a substrate 1 having energy generating elements 4, an insulating layer 5 and electric wiring layers (not shown) as shown in FIG. 8A is prepared. The insulating layer 5 is formed by a plurality of component insulating layers and the electric wiring layers are arranged among the component insulating layers.

Figure 8B:
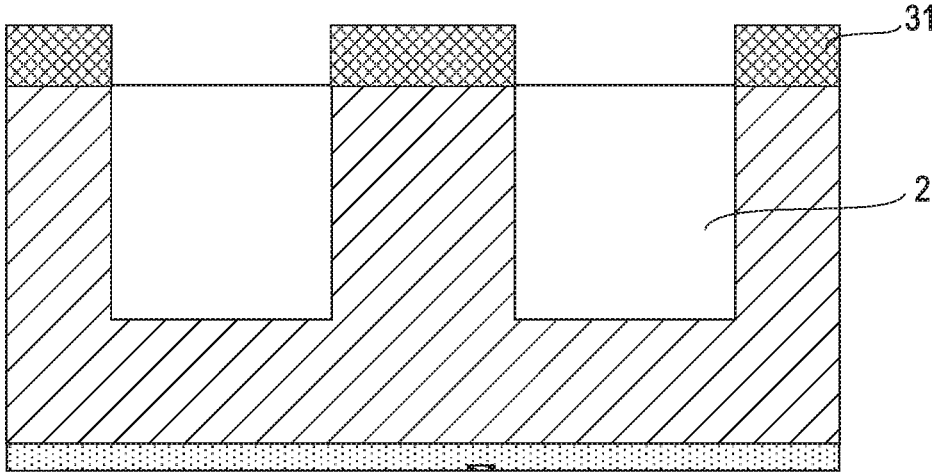

Then, an etching mask 31 is arranged on the rear surface of the substrate 1 and the first supply paths 2 are produced by means of reactive ion etching as shown in FIG. 8B. The etching mask 31 can be formed typically by using silicon oxide, silicon nitride, silicon carbide, silicon carbonitride or photosensitive resin.

Figure 8C:
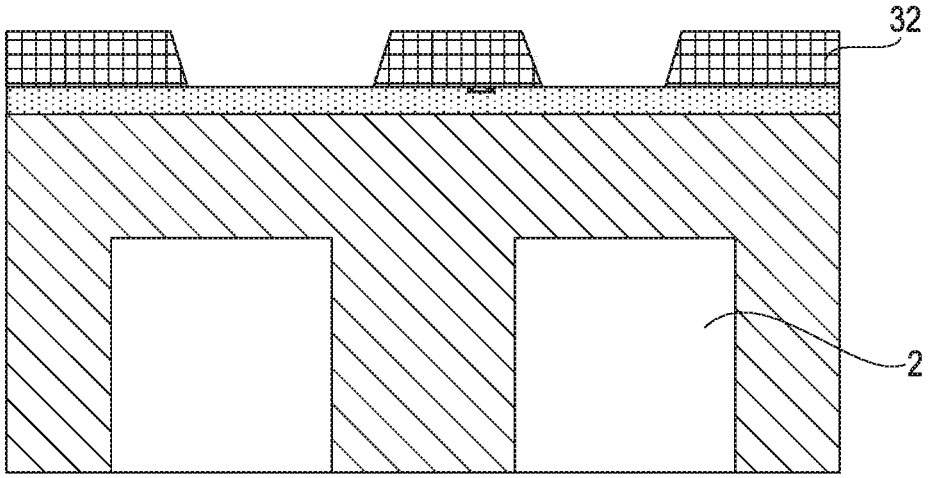

Subsequently, another etching mask 32 is arranged on the front surface of the substrate 1 as shown in FIG. 8C. Materials similar to those that can be used to form the etching mask 31 can also be employed to form the etching mask 32. The etching mask 32 has openings and, in the cross sections of the openings, the openings preferably show a tapered profile thereunder. Such cross sections under the respective openings, which show a tapered cross-sectional profile, can be produced by optimizing the exposure conditions, the PEB/development conditions and the prebake conditions.

Figure 8D:
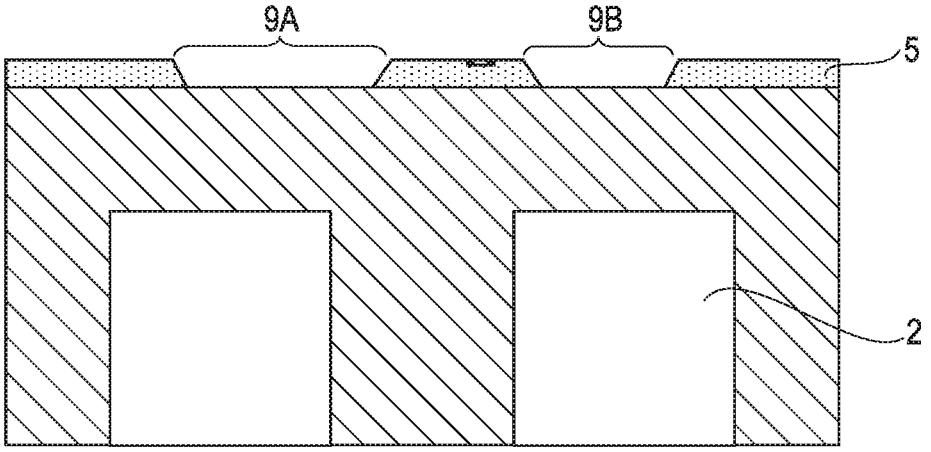

Thereafter, as shown in FIG. 8D, the insulating layer 5 is etched by means of reactive ion etching to produce opening regions 9 in the insulating layer 5. The use of reactive ion etching is particularly preferable when the insulating layer 5 has a multilayer structure. In such an instance, for example, firstly positive type resist is applied onto the insulating layer 5 and then the positive type resist is subjected to a patterning process that includes exposure, heating and development to produce a resist mask. The heating operation is preferably executed at temperatures not lower than 90° C. and not higher than 120° C. Under such a condition, the openings of the mask can be made to show a taper angle of not less than 90 degrees. As a reactive ion etching process is executed by using such a mask, the wall surfaces 5*a* of the insulating layer 5 can be made to be inclined surfaces that show an angle of inclination of less than 90 degrees relative to the front surface 1*a* of the substrate 1. When the wall surfaces 5*a* are made to be inclined surfaces, liquid can easily flow toward the energy generating elements 4. The angle formed by each of the wall surfaces 5*a* of the insulating layer 5, which are inclined surfaces, and the front surface 1*a* of the substrate 1 (the angle at the lower end of each of the wall surfaces 5*a* on the side of the insulating layer 5) is preferably not less than 45° and less than 90°. The wall surfaces 5*a* are made to be inclined surfaces that are inclined relative to the front surface 1*a* of the substrate 1 when the above-defined angle is made to be less than 90°. When, on the other hand, the angle is made to be less than 45°, the wall surfaces 5*a* transversally extend too much and such transversally excessively extended wall surfaces can in turn adversely affect the wirings and other components of the liquid ejection head. Additionally, the use of a relatively large taper angle of not less than 45° makes the wall surfaces 5*a* as a whole to be located closer to the energy generating elements 4 and hence is advantageous from the viewpoint of refilling efficiency. Furthermore, when liquid is circulated in a liquid ejection head according to the present invention, the flow resistance is reduced by making the wall surfaces 5*a* show a tapered profile. Then, such a tapered profile raises the circulation efficiency and improves the effect of reducing the density of the highly dense portions of the liquid in circulation. FIG. 8D shows the stage in the manufacturing process where the etching mask 32 is removed.

Figure 8E:
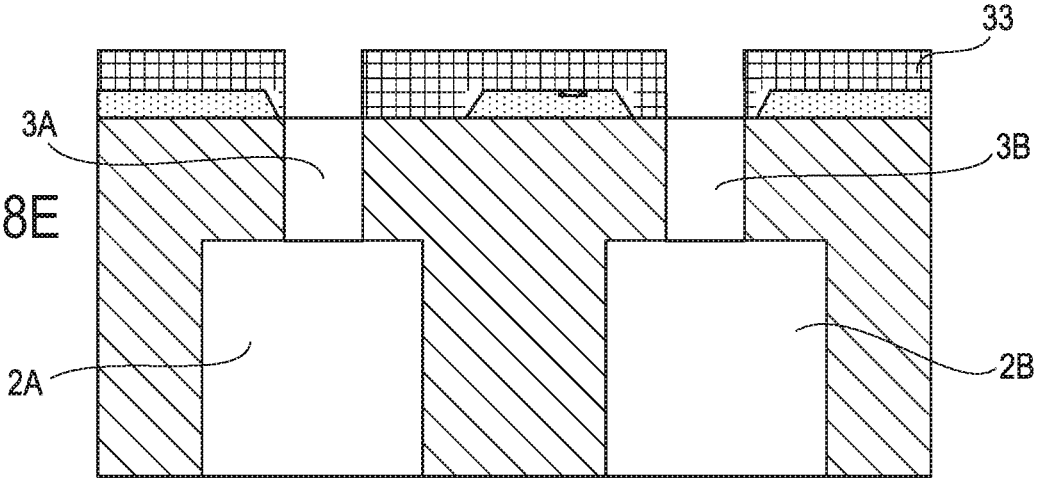

Then, another etching mask 33 is formed on the front surface side of the substrate 1 as shown in FIG. 8E. Materials similar to those that can be used to form the etching mask 31 as listed above can also be employed to form the etching mask 33. Thereafter, the substrate 1 is etched to produce the second supply paths 3. Each of the second supply paths 3 is formed in an area located inside the corresponding opening region 9. More specifically, each of the second supply paths 3 is formed inside the corresponding opening region 9 at a position separated from the opening of the opening region 9 by a certain distance at least on the side thereof where the corresponding energy generating element 4 is arranged close by. Thus, the etching operation is executed in a state where the etching mask 33 is found in the inside of each of the opening regions 9 to produce the second supply path 3 there. With such an arrangement for the etching operation, the lower ends of the opening regions 9 on the side of the energy generating elements 4 can be made to be located at positions closer to the energy generating elements 4 and separated from the respective corresponding edges of the openings of the supply paths.

Figure 8F:
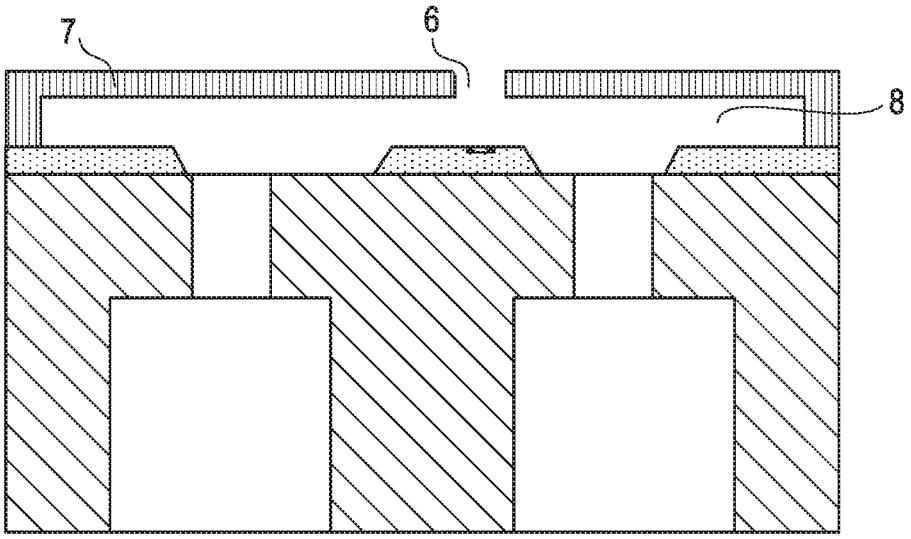

Thereafter, the etching mask 33 is removed and an ejection orifice forming member 7 to be used for forming a flow path 8 and ejection orifices 6 is arranged as shown in FIG. 8F. The ejection orifice forming member 7 can be formed typically by using a plurality of dry films. Exemplar dry films that can be used for forming the ejection orifice forming member 7 include polyethylene terephthalate (to be referred to as PET hereinafter) films, polyimide films and polyamide films. After bonding the dry films onto the substrate 1, the support member of the dry films is peeled off. For the purpose of removing the support member, a release process is preferably executed in advance between the dry films and the support member. A liquid ejection head according to the present invention can be manufactured by way of the above-described manufacturing process.

Second Embodiment

Figure 4A:
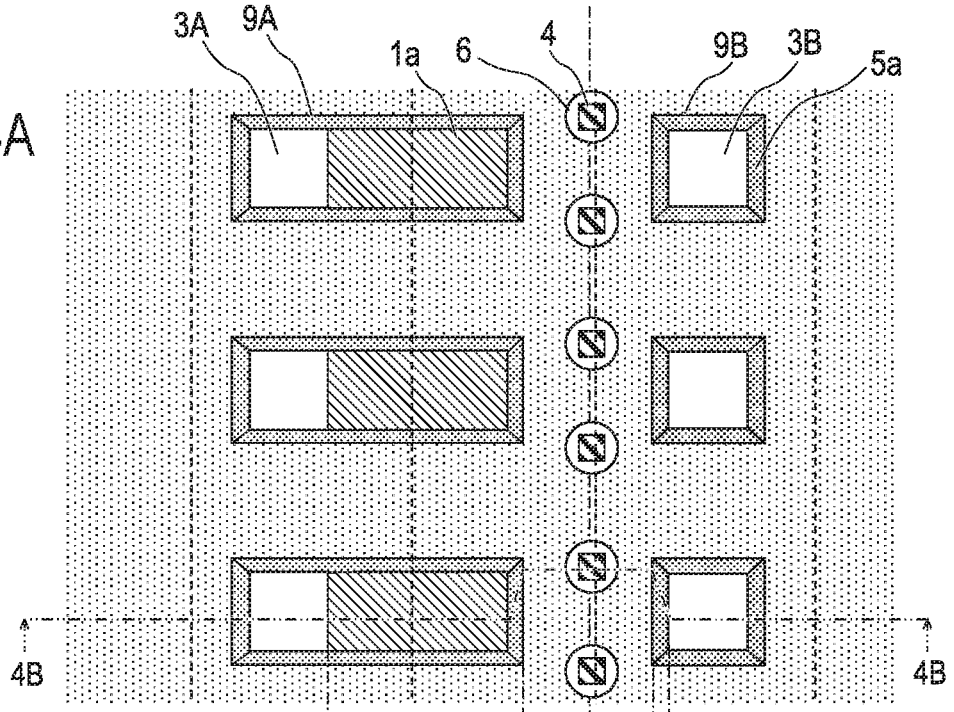
FIGS. 4A and 4B are respectively a schematic top view and a schematic cross-sectional view of the second embodiment of liquid ejection head according to the present invention.
Figure 4B:
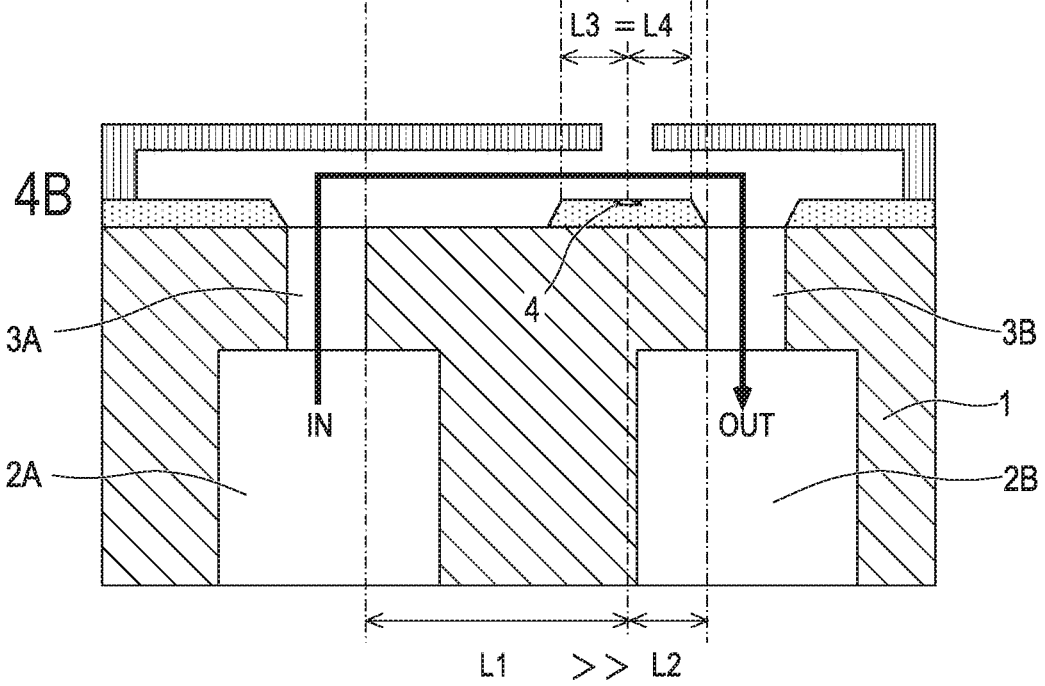

FIGS. 4A and 4B show the second embodiment of liquid ejection head according to the present invention. The second embodiment of liquid ejection head will be described below mainly in terms of differences between this embodiment and the first embodiment.

While the distance L2 of this embodiment is further reduced if compared with that of the first embodiment, the distances L3 and L4 are substantially the same in the two embodiments. The contour of the bottom of each of the opening regions 9B of the insulating layer is made to substantially agree with the contour of the opening of each of the individual outflow paths 3B. Such contours that agree with each other can be realized by using the same mask both for forming the opening regions 9B and for forming the individual outflow paths 3B as will be described hereinafter in Example 2.

The positions of the second supply paths 3 relative to the first supply paths 2 of this embodiment are the same as those of the first embodiment but the positions of the energy generating elements and those of the ejection orifices of this embodiment differ from their counterparts of the first embodiment. The density of the highly dense portions of the liquid that is being circulated in this embodiment can further be reduced by forming the individual outflow paths 3B at positions located closer to the energy generating elements 4. Additionally, since the center positions of the second supply paths do not need to be shifted from the center positions of the first supply paths, no outward bends need to be formed in areas linking the first supply paths and the second supply paths and hence no burr-producing problem will arise.

Third Embodiment

Figure 5A:
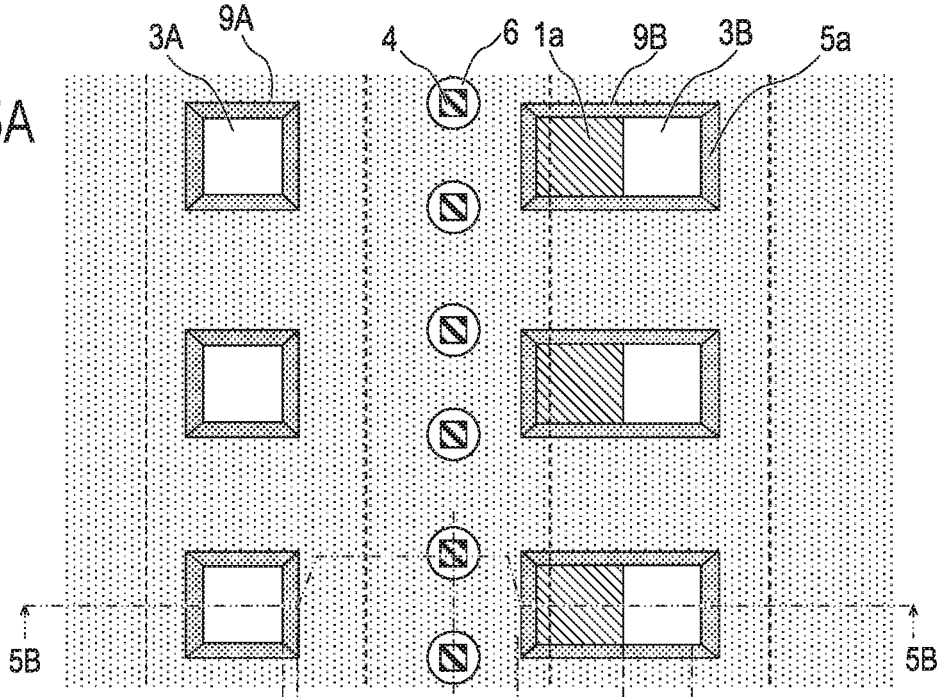
FIGS. 5A and 5B are respectively a schematic top view and a schematic cross-sectional view of the third embodiment of liquid ejection head according to the present invention.
Figure 5B:
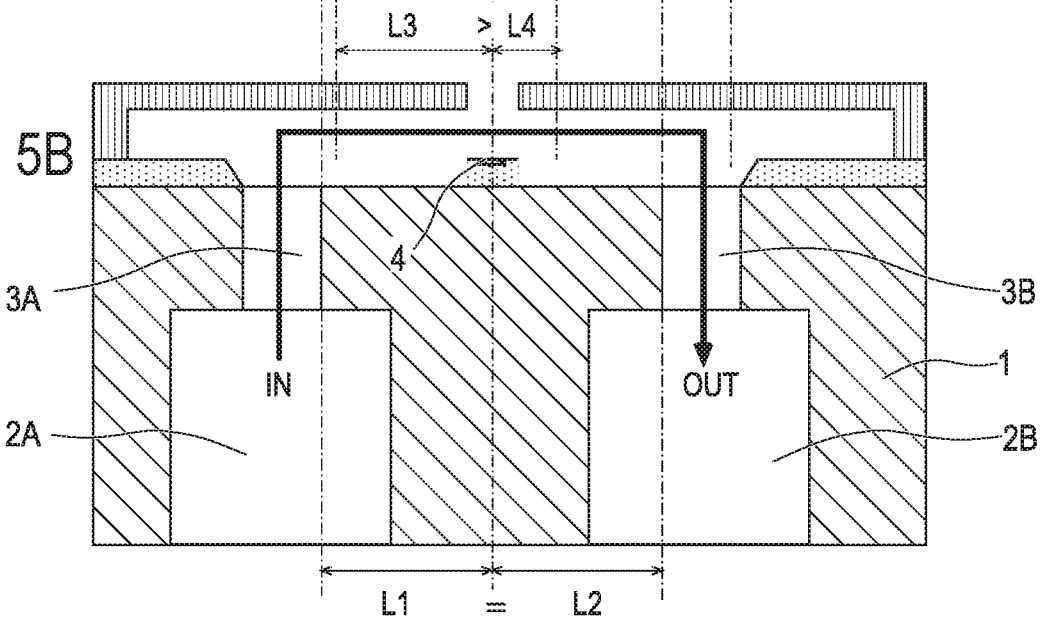

FIGS. 5A and 5B schematically illustrate the third embodiment of liquid ejection head according to the present invention. This embodiment will be described below mainly in terms of differences between this embodiment and first and second embodiments.

In this embodiment, the individual inflow paths 3A, the individual outflow paths 3B, ejection orifices 6 and energy generating elements 4 are so formed as to make L1=L2 hold true.

With regard to scraping off the insulating layer 5, on the other hand, the positions of scraping off the insulating layer 5 are so selected as to allow the insulating layer 5 to be scraped off broader on the side of the individual outflow paths and make L3>L4 reliably hold true. While the opening regions 9 formed in the insulating layer 5 of this embodiment are made to show profiles that differ from those of the opening regions 9 of the preceding embodiments in the above-described manner, the density of the highly dense portions of the liquid that is being circulated in the liquid ejection head of this embodiment can satisfactorily be reduced.

Fourth Embodiment

Figure 6A:
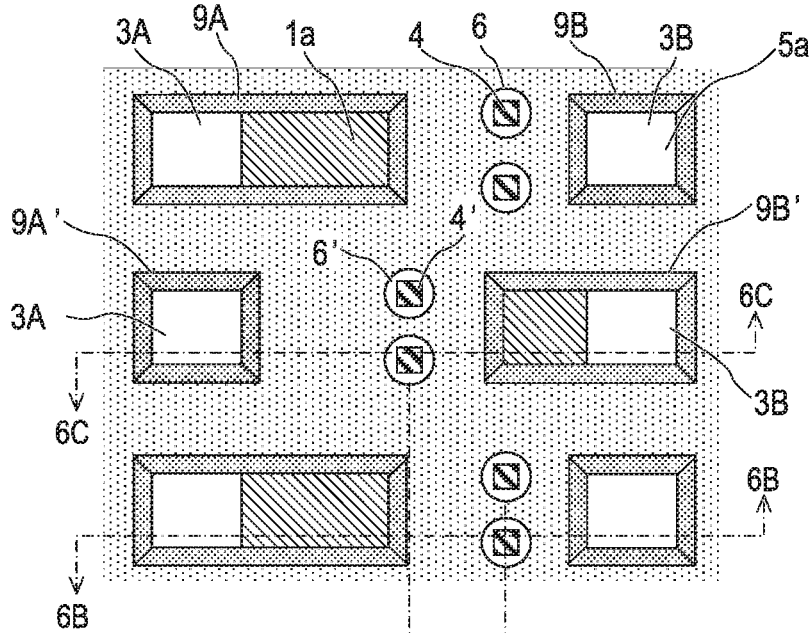
FIGS. 6A, 6B and 6C are respectively a schematic top view, a schematic cross-sectional view and another schematic cross-sectional view of the fourth embodiment of liquid ejection head according to the present invention.
Figure 6B:
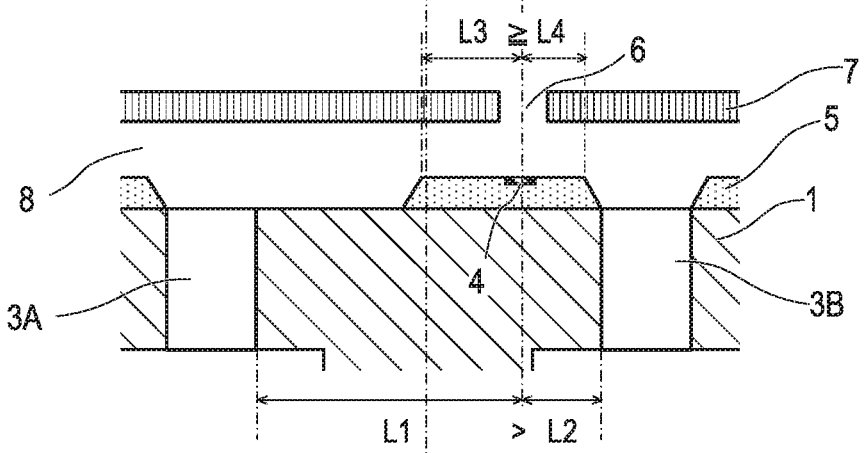
Figure 6C:
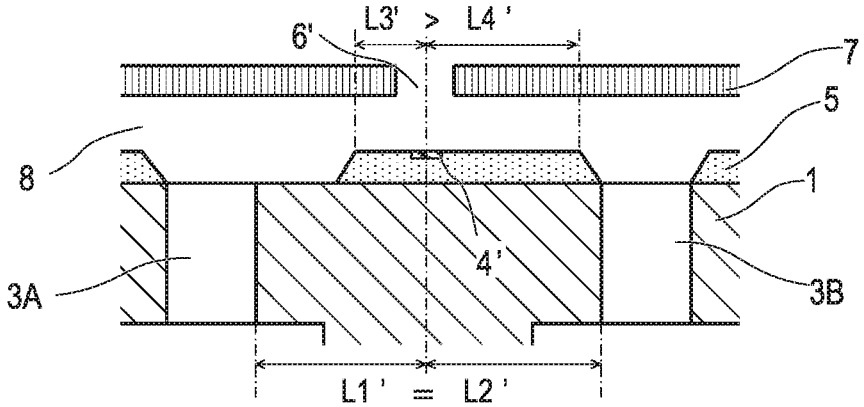

FIGS. 6A through 6C schematically illustrate the fourth embodiment of a liquid ejection head according to the present invention. As seen from the plan view of FIG. 6A, the energy generating elements 4 and the ejection orifices 6 are arranged in a staggered manner. More specifically, the energy generating elements 4 and the ejection orifices 6 are arranged in two rows including the first row that is located close to the individual inflow paths 3A and the second row that is evenly spaced from the row of the individual inflow paths 3A and from the row of the individual inflow paths 3B to make all the energy generating elements 4 and the ejection orifices 6 show a staggered positional arrangement (with all the rows running vertically in FIG. 6A). In other words, the relationships of L1>L2 and L3>L4 are made to hold true as in the first embodiment and second embodiment in the cross-sectional view of FIG. 6B taken along line 6B-6B in FIG. 6A. The group of liquid inflow paths and liquid outflow paths as seen from FIG. 6B is referred to as the group of liquid inflow paths and the group of liquid outflow paths that correspond to the first row. On the other hand, in the cross-sectional view of FIG. 6C taken along line 6C-6C in FIG. 6A, the relationships of L1'=L2' and L3'>L4' are made to hold true as in the third embodiment. The group of liquid inflow paths and liquid outflow paths as seen from FIG. 6C is referred as the group of liquid inflow paths and the group of liquid outflow paths that corresponds to the second row. The positions for forming the energy generating elements 4 and the ejection orifices 6 of the first row and those for forming the energy generating elements 4 and the ejection orifices 6 of the second row are optimized within the limit of satisfying the requirement of the relationship of L1>L1'≥2'>L2. As the energy generating elements 4 and the ejection orifices 6 are formed to make them show a staggered positional arrangement in the above-described manner, both the degree of freedom for designing the electric wirings and the degree of freedom for designing the ejection orifices are improved. Additionally, the density of the highly dense portions 10 of the liquid that is being circulated in the liquid ejection head can be reduced by optimizing the positions of the first openings, the second openings and the ejection orifices for both the first row and the second row as shown in FIGS. 6B and 6C.

EXAMPLES

Now, the present invention will be described more specifically in greater detail by way of examples.

Example 1

The method of manufacturing the liquid ejection head of this example will be described below. First, a substrate 1 having TaSiN-made energy generating elements 4, a silicon oxide-made insulating layer 5 and Al-made electric wiring layers (not shown) on the front surface side thereof as shown in FIG. 8A was prepared. The substrate 1 was a silicon single crystal substrate. The insulating layer 5 had a multilayer structure and was 10-μm thick. A total of four electric wiring layers were arranged in the inside of the insulating layer 5 and all the electric wiring layers were connected to each other by tungsten plugs.

Then, an etching mask 31 was arranged on the rear surface, which was the surface opposite to the front surface, of the substrate 1 and the first supply paths 2 were formed in the substrate 1 by means of reactive ion etching as shown in FIG. 8B. The etching mask 31 had openings that were formed on the opposite sides of the row of the energy generating elements so as to sandwich the energy generating elements between them and make the ends of the opening regions 9B to be located close to the row of the energy generating elements. In this example, the etching mask 31 was formed by means of novolak-based photoresist. The first supply paths 2 were made to have a depth of 500 μm. $SF_6$ gas was employed in the etching step and $C_4F_8$ gas was employed in the coating step. The gas pressure was made to be equal to 10 Pa and the gas flow rate was made to be equal to 500 sccm. The etching time was 20 seconds and the coating time was 5 seconds. A bias power of 150 W was applied to the platen for 10 seconds within the etching time of 20 seconds. Note that the above-described reactive ion etching technique is referred to as Bosch process.

Thereafter, the etching mask 31 was removed and another etching mask 32 was arranged on the front surface side of the substrate 1 as shown in FIG. 8C. More specifically, firstly novolak-based positive type photoresist was applied to a thickness of 20 μm and prebaked at 150° C. Then, the photoresist was exposed to light and developed to produce the etching mask 32.

Subsequently, an etching process was executed on the insulating layer 5 by means of reactive ion etching, using the etching mask 32, to produce opening regions 9A and 9B in the insulating layer 5 as shown in FIG. 8D. The reactive ion etching process was executed by using a mixture gas of $C_4F_8$ gas, $CF_4$ gas and Ar gas with a $C_4F_8$ gas flow rate of 10 sccm and by applying a bias power of 100 W to the platen. In the etching process, the silicon-made substrate 1 took the role of an etching stop layer. More specifically, as the process of etching the insulating layer went on, the etched regions (etching gas) eventually got to the substrate 1. Since the etch selectivity of the insulating layer 5 relative to the substrate 1 is not less than 100, the etching process was stopped after getting to the substrate 1. Thus, the substrate 1 was made to operate as etching stop layer. Note that, when over-etching was allowed to take place up to 20% after etching the insulating layer 5, the substrate 1 was calculatedly scraped off by 0.02 μm. Thus, the height of the insulating layer 5 was substantially made to be equal to the height of the opening regions 9.

Thereafter, still another etching mask 33 was formed as shown in FIG. 8E. Novolak-based positive type photoresist was employed for the etching mask 33, which was made to have a film thickness of 20 μm, and the etching mask 33 was subjected to a patterning operation by means of photolithography. Intended positions for forming openings were inside of the opening regions 9A and the opening regions 9B. Subsequently, the second supply paths 3 were formed in the substrate 1 by means of reactive ion etching as in the instance of forming the first supply paths 2.

Thereafter, the etching mask 33 was removed and an ejection orifice forming member 7 for producing a flow path 8 and ejection orifices 6 was formed by applying a dry film that contained epoxy resin onto the substrate 1 as shown in FIG. 8F.

The liquid ejection head of this example as shown in FIGS. 1A and 1B was prepared in the above-described manner.

In the liquid ejection head 1 of Example 1, the row of the ejection orifices 6 was off-centered toward the side of the individual outflow paths 3B (L1>L2) as shown in FIGS. 1A and 1B. This means that the highly dense portions 10 of the liquid in the liquid ejection head that appeared at and near the ejection orifices were located closer to the individual outflow paths 3B. Additionally, the distance L4 from the center line of the ejection orifices 6 to the ejection orifice-side end 9*b* of the opening of each of the opening regions 9B is smaller than the distance L3 from the center line of the ejection orifices 6 to the ejection orifice-side end 9*a* of the opening of each of the opening regions 9A (L3>L4). Therefore, the highly dense portions 10 of the liquid in the liquid ejection head 1 that appeared at and near the ejection orifices were discharged quickly from there so that the density of those portions 10 was also quickly reduced. Additionally, since the opening regions of the insulating layer on the side of the individual inflow paths were formed by scraping off the insulating layer 5 at positions located close to the row of the energy generating elements, liquid was stably refilled after each liquid ejection process to prove that the liquid ejection head of this example was highly reliable and free from the risk of image quality degradation.

Example 2

In Example 2, a liquid ejection head as shown in FIGS. 4A and 4B was manufactured.

Figure 9A:
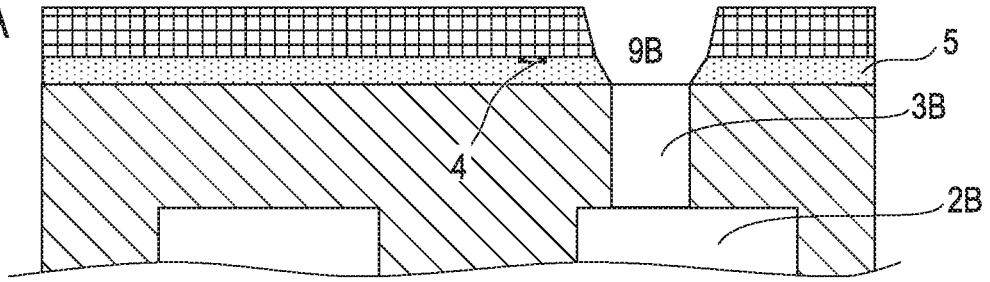
FIGS. 9A, 9B, 9C and 9D are schematic cross-sectional views showing the different manufacturing steps of the method of Example 2.

Common supply paths 2 were formed and then an etching mask 32 was formed on the front surface side of the substrate 1 as in Example 1. More specifically, the etching mask 32 was so prepared as to form only the openings for the second supply paths (individual outflow paths 3B) on one of the opposite sides of the energy generating elements. After forming openings 9B by etching the insulating layer, the substrate 1 was subjected to an etching process, using the same mask, to make the openings 9B of the individual outflow paths 3B communicate with the common outflow path 2B (FIG. 9A). In this example, as a result of using the same mask for etching both the insulating layer and the silicon substrate, it was possible to form the energy generating elements 4 at positions located closer to the side of the individual outflow paths 3B by about 2 μm if compared with the instances where two exposure operations were needed to be executed and hence there was no need to worry about mispatterning such as misalignment. Furthermore, as a result, the ejection orifices 6 that were located right above the respective energy generating elements 4 could also be brought closer to the side of the individual outflow paths 3B.

Figure 9B:
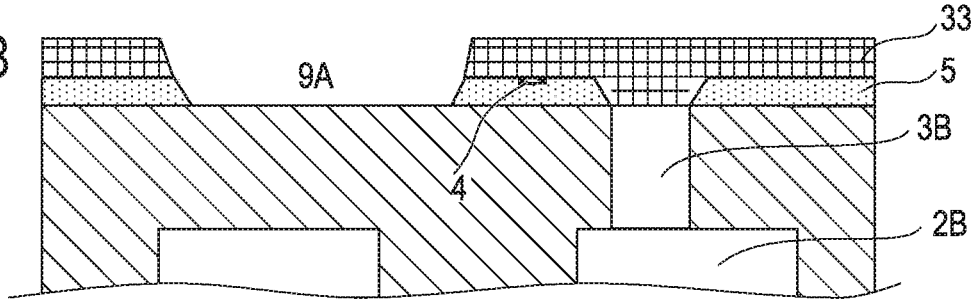
Figure 9C:
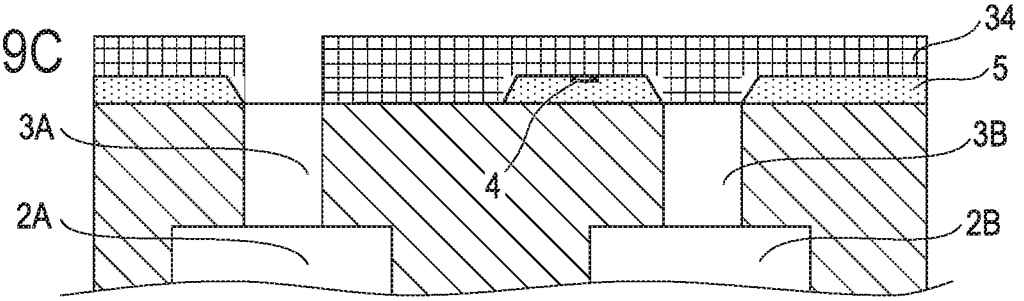

Thereafter, the etching mask 32 was removed. Then, another etching mask 33 was formed to produce openings for the remaining second supply paths and opening regions 9A were formed in the insulating layer 5 by means of etching (FIG. 9B). Furthermore, after removing the etching mask 33, still another etching mask 34 was formed to etch the silicon substrate 1 and make the individual inflow paths 3A, which were the remaining second individual supply paths, communicate with the common inflow path 2A (FIG. 9C). Note that the operation of forming the individual supply paths and that of forming the common supply paths may not necessarily follow the above-described order.

Figure 9D:
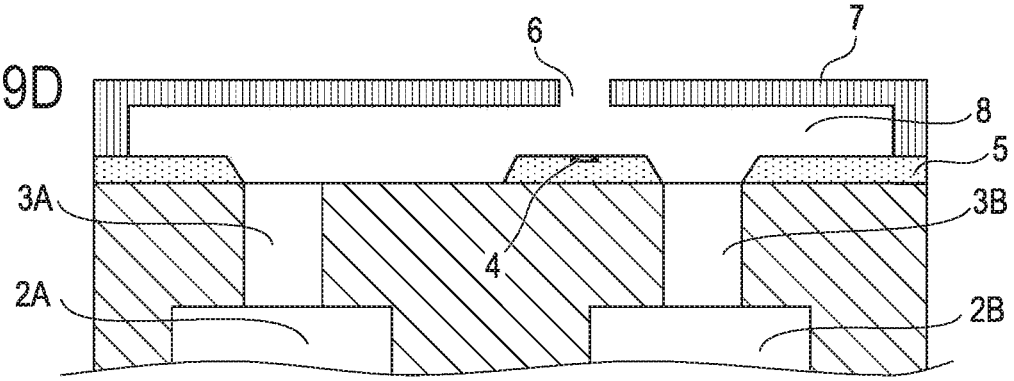

Subsequently, an ejection orifice forming member 7 for forming a flow path 8 and ejection orifices 6 was formed as in Example 1 to manufacture the liquid ejection head of Example 2 (FIG. 9D). When compared with Example 1, the ejection orifices 6 of the liquid ejection head of Example 2 were located closer to the side of the individual outflow paths 3B so that the density of the highly dense portions of the liquid in the liquid ejection head could more easily be reduced. Additionally, since the opening regions 9A were formed by scraping off the insulating layer such that the ends thereof are located closer to the row of the ejection orifices, liquid was stably refilled after each liquid ejection process to prove that the liquid ejection head of this example was highly reliable and free from the risk of image quality degradation.

Example 3

In Example 3, a liquid ejection head as shown in FIGS. 5A and 5B was manufactured.

More specifically, common supply paths 2 were formed in a substrate 1 as in Example 1 and an etching mask 32 was formed on the front surface side of the substrate 1. While the common supply paths 2 were formed as in Example 1 as pointed out above, the openings of the etching mask 32 were so formed as to be spaced from the row of the energy generating elements by the same distance.

Thereafter, the individual supply paths were formed such that the insulating layer was scraped off broader on the side of the individual outflow paths. Subsequently, the individual supply paths were formed as in Example 1.

The liquid ejection head of Example 3 was manufactured in the above-described manner. The density of the highly dense portions of the liquid in the liquid ejection head of Example 3 was reduced as in Example 1 to prove that the liquid ejection head of this example was highly reliable and free from the risk of image quality degradation.

Example 4

In Example 4, a liquid ejection head as shown in FIGS. 6A through 6C was manufactured.

More specifically, common supply paths 2 were formed in a substrate 1 as in Example 1, on which substrate energy generating elements 4 had been arranged in a staggered manner, and an etching mask 32 was formed on the front surface side of the substrate 1. Openings were formed in the etching mask 32 to be placed on the front surface of the substrate 1 at positions that were arranged in a staggered manner just like the energy generating elements 4. While an example of staggered arrangement is shown in FIGS. 6A through 6C, the manner in which openings are arranged in a staggered manner is not limited to the illustrated one.

The degree of freedom for designing both electric wirings and ejection orifices is raised by such a staggered arrangement.

The liquid ejection head of Example 4 was manufactured in the above-described manner. The density of the highly dense portions of the liquid in the liquid ejection head was reduced as in Example 1 to prove that the liquid ejection head of this example was highly reliable and free from the risk of image quality degradation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-240865, filed Dec. 25, 2018, which is hereby incorporated by reference herein in its entirety.

What is claimed is:

1. A liquid ejection head comprising:

a liquid flow path having an ejection orifice; and an energy generating element for generating energy for ejecting liquid from the flow path through the ejection orifice, the liquid flow path and the energy generating element being formed on a first surface of a substrate having the first surface and a second surface disposed oppositely relative to each other, the energy generating element being protected against liquid by an insulating layer formed on the first surface of the substrate, the liquid ejection head further comprising:

a liquid inflow path running through the substrate and the insulating layer so as to allow liquid to flow into the flow path from the second surface side of the substrate; and a liquid outflow path running through the substrate and the insulating layer so as to allow liquid to flow out from the flow path to the second surface side of the substrate, the liquid inflow path and the liquid outflow path each respectively having a first opening formed on the first surface of the substrate after running through the substrate and a second opening formed on the insulating layer after running through the insulating layer, the ejection orifice being arranged between the liquid inflow path and the liquid outflow path, an ejection orifice side end of the second opening being located closer to the ejection orifice than an ejection orifice side end of the first opening for each of the liquid inflow path and the liquid outflow path, the relationships of $L1 \geq L2$ and $L3 \geq L4$ holding true, with the proviso that $L3 > L4$ when $L1 = L2$ and $L1 > L2$ when $L3 = L4$, where L1 is the distance from the center position of the ejection orifice to the ejection orifice side end of the first opening of the liquid inflow path;

L2 is the distance from the center position of the ejection orifice to the ejection orifice side end of the first opening of the liquid outflow path;

L3 is the distance from the center position of the ejection orifice to the ejection orifice side end of the second opening of the liquid inflow path; and L4 is the distance from the center position of the ejection orifice to the ejection orifice side end of the second opening of the liquid outflow path.

2. The liquid ejection head according to claim 1, wherein an ejection orifice side wall surface of a part of the liquid inflow path and an ejection orifice side wall surface of a part of the liquid outflow path that run through the insulating layer include an inclined surface that is inclined relative to the first surface of the substrate.

3. The liquid ejection head according to claim 2, wherein the angle formed by the ejection orifice side wall surface of at least one of the part of the liquid inflow path and the part of the liquid outflow path and the first surface of the substrate is not less than 45 degrees and less than 90 degrees.

4. The liquid ejection head according to claim 2, wherein a flat area is formed between the bottom of the ejection orifice side wall surface and the ejection orifice side end of each of the first openings by scraping off the insulating layer.

5. The liquid ejection head according to claim 3, wherein a flat area is formed between the bottom of the ejection orifice side wall surface and the ejection orifice side end of each of the first openings by scraping off the insulating layer.

6. The liquid ejection head according to claim 1, wherein L1/L2 is not less than 1.1 when L1 and L2 have a relationship of L1>L2.

7. The liquid ejection head according to claim 1, wherein the insulating layer includes one or more electric wiring layers.

8. The liquid ejection head according to claim 1, wherein the thickness of the insulating layer is not less than 4 μm.

9. The liquid ejection head according to claim 1, wherein the liquid inflow path includes a first supply path having an opening on the second surface of the substrate and a plurality of second supply paths having respective openings on the first surface of the substrate and the liquid outflow path also includes a first supply path having an opening on the second surface of the substrate and a plurality of second supply paths having respective openings on the first surface of the substrate, the plurality of second supply paths being held in communication with the first supply path for each of the liquid inflow path and the liquid outflow path.

10. The liquid ejection head according to claim 9, wherein the liquid ejection head has a plurality of ejection orifices arranged in an arrangement direction and the first supply path is formed to extend in the arrangement direction of the ejection orifices, while the second supply paths are arranged in the arrangement direction of the ejection orifices such that each of the second supply paths corresponds one or more of the ejection orifices.

11. The liquid ejection head according to claim 1, wherein the liquid ejection head has a plurality of ejection orifices arranged in a staggered manner to form a first row and a second row and also has a group of liquid inflow paths and a group of liquid outflow paths that correspond to the first row and a group of liquid inflow paths and a group of liquid outflow paths that correspond to the second row.

12. The liquid ejection head according to claim 1, wherein the liquid ejection head is configured such that the liquid in the flow path is made to circulate between the inside and the outside of the liquid ejection head.

* * * * *